United States Patent [19]

Westphal

[11] 3,964,926

[45] June 22, 1976

[54] CLEANSING RECEPTACLE FOR CAPILLARY WRITING PEN PARTS

[75] Inventor: Werner Westphal, Pinneberg, Germany

[73] Assignee: Koh-I-Noor Rapidograph, Inc., Bloomsbury, N.J.

[22] Filed: Apr. 2, 1975

[21] Appl. No.: 564,391

[30] Foreign Application Priority Data

Apr. 27, 1974 Germany ..... 7414942

[52] U.S. Cl. ..... 134/117; 134/135; 134/143; 134/182; 134/201; 206/5.1

[51] Int. Cl.[2] ..... B08B 3/04; B08B 11/02

[58] Field of Search ..... 134/117, 135, 137, 143, 134/166 R, 182, 201; 206/5.1

[56] References Cited

UNITED STATES PATENTS

| | | | |
|---|---|---|---|
| 1,078,431 | 11/1913 | Grier | 134/117 UX |
| 2,362,251 | 11/1944 | Eggleton | 134/117 UX |
| 2,413,858 | 1/1947 | Borgeat | 134/201 UX |
| 2,627,276 | 2/1953 | Eggleton | 134/143 |
| 2,643,661 | 6/1953 | Shanahan, Jr. | 134/143 |
| 2,652,305 | 9/1953 | Dailey | 134/143 X |
| 3,444,868 | 5/1969 | Hungerford et al. | 134/143 |
| 3,460,552 | 8/1969 | Sturgeon | 134/135 |
| 3,804,236 | 4/1974 | Tanaka | 206/5.1 X |
| 3,834,409 | 9/1974 | Kuparinen | 134/117 |

*Primary Examiner*—Robert L. Bleutge
*Attorney, Agent, or Firm*—David H. Semmes

[57] ABSTRACT

An improved cleaning appliance, particularly for use in cleaning component parts of stylus or tube writing pens. The improved structure includes a holder coupled to the cover, so that the holder is slidable relative to the cover and fixedly supportable by the container when the cover has been fitted to the container.

5 Claims, 4 Drawing Figures

CLEANSING RECEPTACLE FOR CAPILLARY WRITING PEN PARTS

BACKGROUND OF THE INVENTION

1. Field of the Invention

This invention relates to a cleaning appliance, particularly for use in cleaning component parts of tube writing pens.

2. Description of the Prior Art

U.S. Pat. No. 3,834,409 illustrates an appliance which has already been proposed for use in cleaning component parts of tube writing pens; a holder for the parts is placed into a container and a cover forms a seal on the holder so that a gripping lip projects outwards from between the container and the cover. The component parts of tube writing pens can be inserted into socket-like receiving elements and possibly they may also be axially located by annular ribs projecting from the undersurfaces of the cover. In order to clean the component parts of tube writing pens thus loaded into the holder, the closed cleaning appliance containing a cleaning fluid is turned upside down and stood on its cover so that the component parts are completely immersed in a cleaning fluid which dissolves adhering deposits of Indian ink. After a while the cleaning appliance can be turned back again the right way up so that the cleaning fluid will collect at the bottom of the container where it is not in contact with the component parts. The cover can then be removed, the holder lifted out of the container by its gripping edge and held in running water which rinses off the deposits and adhering residues of fluid from the holder and from the components parts.

The above-noted cleaning appliance as such satisfies the requirements such an appliance should fulfill. In particular, it permits the cleaned component parts to be taken out of the cleaning appliance without these having to be touched, and any dirt and fluid can be washed off under a tap. The only difficulty in such a cleaning appliance is that, when the cover is taken off, some cleaning fluid may run down the outside surface of the holder and come into contact with the peripheral gripping edge and soil the same. The deposition of dirt at this point is not desirable because it defeats the purpose of cleaning the component parts of tube writing pens without risk of the user staining his fingers.

SUMMARY OF THE INVENTION

According to the present invention there is provided a cleaning appliance, comprising a container which is open at one end, a cover for closing the open end of the container, and a holder for the reception therein of parts that are to be cleaned, the holder being coupled to the cover so as to be slidable relative to one end thereof and arranged to be supported axially inside the container when the cover has been fitted to the container so that the holder is completely enclosed by the cover and the container.

In this cleaning appliance there is therefore no gripping edge which projects from between the container and the cover since the holder is completely enclosed inside the appliance. The grip in this instance is the cover which is slidably connected to the holder, and the holder can be lifted by the cover out of the container after the cleaning process has been performed. After relative displacement, the two connected parts are so far apart that the holder and the component parts which it contains can be easily flushed in running water whilst the holder is held by the cover which has an external surface not liable to come into contact with cleaning fluid and residues of Indian ink.

Broadly, a can comprising a container, a cover and a holder has already been proposed in U.S. Pat. No. 2,664,854 wherein a permeable holder is completely enclosed by a container, and a cover applied, but such a holder has utility only for holding artificial flies for fishing and is not connected to the cover; the flies which are wetted by the liquid inside the container must either be directly taken out of the holder or lifted out of the container together with the entire holder which has been wetted by the liquid. If this type of can were intended to be used for cleaning pens, the user would certainly be unable to prevent his fingers from being stained.

For the purpose of connecting the holder to the cover, the inside of the cover is preferably provided with a pin which extends through the holder so that, within limits, the holder and the pin are relatively slidably displaceable axially of the pin.

The holder and cover can be particularly easily assembled if the free end of the pin is formed with barb-like configurations and these are divided in an axial plane of the pin so that the divided barbs can be squeezed together. This permits the pin to be passed through an appropriate opening in the holder and the barb-like configurations will then prevent the two connected parts from being accidentally pulled apart.

In the interests of simplicity of manufacture, the pin and the cover may preferably be an integral moulding of a synthetic plastic material.

As in the above-noted and described previously proposed cleaning appliance, the holder according to the instant invention should be at the top of the container to prevent the cleaning fluid from contacting the component parts that are to be cleaned when the appliance stands upright on the base of its container, while the cleaning fluid will immerse the component parts when the appliance is upside down. In order to ensure this advantageous operation for the present invention, the internal walls of the container are formed with axially extending ribs which limit the displaceability of the holder; keeping the inserted holder near the container top.

In order to enable the invention to be more readily understood, reference will now be made to the accompanying drawings, which illustrate diagrammatically and by way of example an embodiment thereof, and in which:

DESCRIPTION OF THE PREFERRED EMBODIMENT

Figure 1:
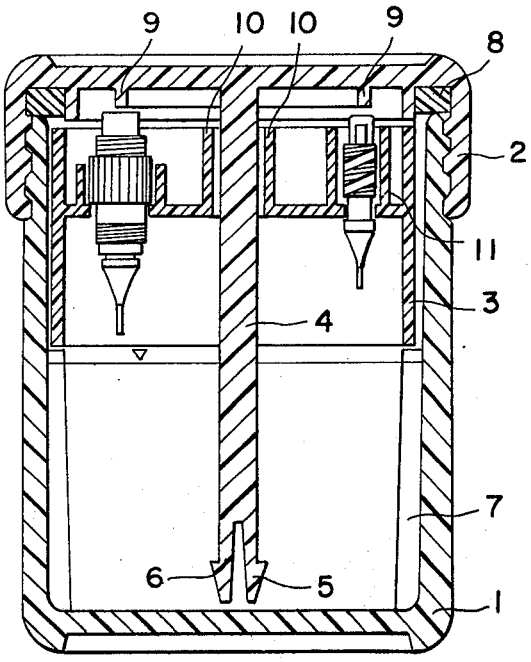
FIG. 1 is a section through an appliance for use in cleaning the component parts of tube writing pens, according to the present invention.
Figure 3:
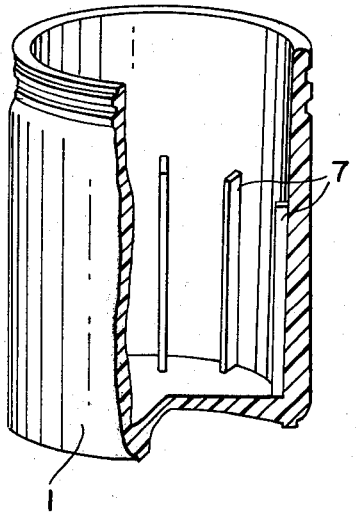
FIG. 3 is a detail showing a container part of the cleaning appliance of FIG. 1, a portion of the wall being broken away.

Referring now to the drawings, there is shown an appliance for use in cleaning the component parts of tube writing pens, the appliance consisting of a container 1, a cover 2 and a holder 3 which is insertable into the interior of the container. The container 1 has formed on its internal wall axially extending ribs 7 which are integral with the container 1, preferably itself a plastics moulding, where the upper ends of the ribs 7 serve to support the holder 3 as inserted into the cleaning appliance; according and with reference to FIG. 1.

Around the open mouth of the container 1 are formed external threads for the reception of the cover 2 which itself is formed with mating internal threads. In order to ensure a good seal, the cover also contains an annular sealing member 8 which is operable to make sealing contact with the open edge of the container as the cover 2 is screwed tight.

The holder 3 is formed with a number of sockets 11 for the reception therein of component parts of tube writing pens which are desired to be cleaned. In FIG. 1 a writing point of such a pen, as well as a barrel, are shown loaded into the holder with these components prevented from falling out by an annular rib 9 formed on the under side of the cover.

Figure 2:
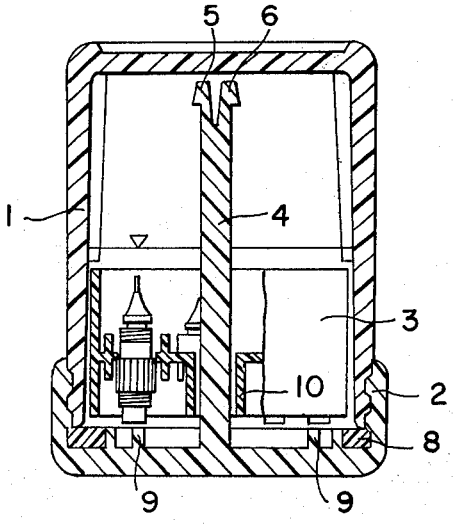
FIG. 2 is a view, similar to FIG. 1, and showing the appliance after it has been turned upside down so that the component parts that are to be cleaned are immersed in a cleaning fluid.
Figure 4:
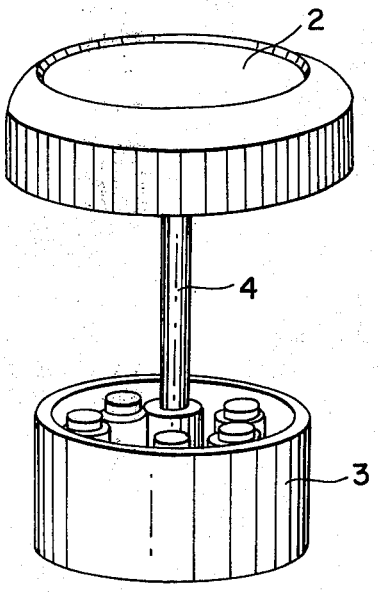
FIG. 4 is a perspective view showing a cover and holder of the cleaning appliance of FIG. 1 coupled together and shown relatively displaced.

At its center, the holder 3 is formed with an opening defined by a circular wall 10, for the passage of a pin 4, therethrough. The pin is integrally formed together with the cover 2; preferably likewise of a synthetic molded plastic. The free or distal end of the pin has two barb-like congurations 5 and 6 divided by an axial slit cut into the end of the pin 4. The two barb-like configurations 5 and 6 can be squeezed together and the end of the pin thus pushed through the central opening in the holder 3 until the pin occupies the position shown in FIGS. 1 and 2. The barb-like elements 5 and 6 therefore prevent the holder from accidentally becoming detached from the cover, yet the two parts can be relatively longitudinally slidably displaced as far as the length of the pin 4 permits, as shown in FIG. 4.

When component parts of tube writing pens require cleaning, they are simply inserted into sockets 11 in the holder 3 and the container 1 is then filled with a cleaning fluid to a certain level (not shown in the drawings). Preferably the cleaning fluid should reach a level just below the upper ends of the ribs 7 when the appliance is in the position shown in FIG. 1. When the holder 3 has been introduced into the container 1, and the cover 2 has been screwed on tight, the entire cleaning appliance may be turned upside down to the position shown in FIG. 2; a position in which all the component parts will be completely immersed in the cleaning fluid. In this context it may be mentioned that the holder contains additional orifices (not shown in the drawings) to permit the cleaning fluid to pass from one side to the other.

After a while, the cleaning appliance is simply turned back into its former and upright position, that shown in FIG. 1, and the cover 2 is then unscrewed. The holder 3 carrying the component elements can now be lifted out of the container 1 by the attached cover 2 since the pin 4 will slide through the central opening in the holder until the barb-like configurations 5 and 6 are intercepted by the underside of the holder 3; the relative position of these two parts will then be that shown in FIG. 4. In this position the holder 3 can be immersed in running water, the user holding the assembly shown in FIG. 4 by gripping the peripheral surface of the cover which has not been exposed to the cleaning fluid or to dissolved residues of Indian ink, and which is therefore clean. After rinsing in running water, the cleaned component parts can be taken out without the user having to stain his hands.

Manifestly, minor changes in details of construction can be effected without departing from the spirit and scope of the invention which is defined in, and limited solely by, the appended claims.

I claim:

1. A cleansing receptacle of the type used for cleaning the several components of capillary writing pen parts, comprising:

A. a container, adapted to be partially filled with cleaning solution, having a closed end and an open end, a cover for said open end and having coupled thereto a holder adapted for reception of parts to be cleaned, wherein;

B. said cover and holder coupling comprises a pin extending axially and inwardly from said cover through a complementary axial hole within said holder, said holder being axially slidable thereupon wherein said pin at its distal end includes means to limit axial displacement, and;

C. said container further including a plurality of ribs formed axially extending from said closed end upon its inner walls operable to axially support and limit the inward displaceability of said holder inside and near the top of said container when said cover and holder assembly has been fitted to said container, thereby completely enclosing said holder by said cover and said container and further maintaining said pen parts above said cleaning solution when said assembly is in an upright position.

2. A cleansing receptacle as in claim 1 wherein said means to limit axial displacement comprise a barb-like configuration on the distal end of said axially and inwardly extending pin.

3. A cleansing receptacle as in claim 2 wherein said barb-like configuration comprises a pair of barbs divided about an axial plane of said pin, whereby said barbs can be squeezed together to permit said distal end of said pin to pass through said complementary axial hole within said holder.

4. A cleansing receptacle as in claim 1 wherein said means to limit axial displacement of said holder further includes barb-like projections at the distal end of said pin, together with annular rib means at the fixed end of said pin whereby writing implement parts received in said holder are secured above said cleaning solution between said holder and said annular rib means when said cover and holder assembly is fitted upon said container, and said holder is supported, upon said barb-like projections, when said cover is removed from said container.

5. A cleansing receptacle of the type used for cleaning the several components of capillary writing pen parts, comprising:

A. a container adapted to be partially filled with cleaning solution, having a closed end and an open end, a cover for said open end and having coupled thereto a holder adapted for reception of parts to be cleaned, wherein:

B. said cover and holder coupling comprises a pin extending axially and inwardly from said cover and through a complimentary axial hole within said holder, wherein said pin includes at its distal end a configuration to limit axial displacement of said holder comprising a pair of barbs divided about an axial plane of said pin, whereby said barbs can be squeezed together to permit said distal end of said pin to pass through said complementary axial hole within said holder; and C. said container further including means formed upon its inner walls, positioned upwardly from said closed end, operable to axially support and limit the inward displaceability of said holder inside and near the top of said container when said cover and holder assembly has been fitted to said container, thereby completely enclosing said holder by said cover and said container and further maintaining said pen parts above said cleaning solution when said assembly is in an upright position.

* * * * *